US007028929B2

(12) United States Patent
Yang

(10) Patent No.: US 7,028,929 B2
(45) Date of Patent: Apr. 18, 2006

(54) NOZZLE AND MANUFACTURING METHOD THEREOF

(76) Inventor: Shih-Sheng Yang, PO Box 82-144, Taipei (TW)

( * ) Notice: Subject to any disclaimer, the term of this patent is extended or adjusted under 35 U.S.C. 154(b) by 0 days.

(21) Appl. No.: 11/024,488

(22) Filed: Dec. 30, 2004

(65) Prior Publication Data

US 2005/0116067 A1 Jun. 2, 2005

Related U.S. Application Data

(62) Division of application No. 10/409,178, filed on Apr. 9, 2003, now abandoned.

(51) Int. Cl.
*B05B 1/00* (2006.01)

(52) U.S. Cl. ..... 239/597; 239/602; 239/600; 239/587.1; 239/589; 251/342; 251/358; 222/490

(58) Field of Classification Search ..... 239/600, 239/547, 548, 589, 533.13, 597, 602; 222/175; 220/703; 264/255, 259, 328.8; 251/342, 251/358

See application file for complete search history.

(56) References Cited

U.S. PATENT DOCUMENTS 5,791,510 A * 8/1998 Paczonay ..... 220/714
6,070,767 A * 6/2000 Gardner et al. ..... 222/175

* cited by examiner

*Primary Examiner*—Dinh Q. Nguyen
(74) *Attorney, Agent, or Firm*—Leong C. Lei

(57) ABSTRACT

A nozzle and the method for manufacturing thereof are disclosed. The manufacturing method includes the following steps: 1. forming a base with a closure and a supporting frame with two corresponding shafts on the top thereof via extruded hard plastic; 2. inserting a central mold into the supporting frame such that the shafts on the top of the supporting frame may be slightly outward; 3. secondly applying extruded plastic on the top of the supporting frame to form a mouthpiece; and 4. thirdly applying extruded plastic on the bottom of the supporting frame to accomplish a nozzle with excellent touch feeling and firm structure. By way of the above steps, the nozzle according to the present invention presents a soft touch feeling and would not easily fall off of the conduit of the water bag due to the sucking of the user.

5 Claims, 7 Drawing Sheets

NOZZLE AND MANUFACTURING METHOD THEREOF

CROSS-REFERENCE

This is a division of application Ser. No. 10/409,178, filed Apr. 9, 2003 ABN.

FIELD OF THE INVENTION

The present invention relates to an easy made and firmly structured nozzle and the manufacturing method thereof, particularly to a nozzle applicable to a water bag for use in sport, which would hardly falls off of the conduit of the water bag.

DESCRIPTION OF THE PRIOR ARTS

Cycling has become a popular outdoor activity in terms of leisure, sports or traffic transportation. People usually mount a rack on a bicycle for holding the water bottle to solve the drinking issue during cycling. And, to make it convenient to drink water from the bottle on the bicycle, a straw may be provided on the cover of the bottle for drinking purposes, such that the cycler can drink water during cycling, rather than stop to drink. However, given that a bottle usually cannot contain great volume of water, there is a limit of carrying enough water to go far.

When taking outdoor sports such as marathon, mountaineering, jungle adventure, etc. a person needs to prepare a lot of water for necessary use. Therefore, water bags which can carry a great volume of water become popular in markets.

Regarding nozzle structures used in said water bags as disclosed in the U.S. Pat. Nos. 5,601,207, 5,730,336, 5,791,510, 6,032,831 and 6,070,767, the outer appearance of the nozzles are made by injection of single material such as safe PU or silicone. The front end of the nozzle has a plat or cross shape water outlet crevice. The peripheral plastic board of the tiny outlet crevice normally has a natural elasticity so that when the sidewalls of the water outlet crevice are pressed, the peripheral plastic board would close and stop the water flow.

When in use, the user holds the soft nozzle in the mouth and clenches by teeth and lips so as to press the water outlet crevice to be in open status. Operating along with suction by mouth, the user can drink the water in the bag.

In view of the disadvantages appeared in the above-mentioned inventions, the inventor of the present invention disclosed "An Integrally formed nozzle structure with Soft and Har Plastics" under Application Ser. No. 90207693 which has been approved. In order to further improve the nozzle structure to obtain a higher bearing power when the user is biting the nozzle in use and to made the user easily suck the water from the water bag by biting to open the closure in the center of the nozzle, the nozzle is made of soft plastic with comfortable touch feeling. The combination strength between the mouthpiece and the conduit is further enforced. As the top of the nozzle is made of a soft material, the rear bottom of the nozzle would not transform or fall off the threaded base of the conduit due to pressure. Accordingly, the main object of the invention is to provide an endurable soft nozzle.

SUMMARY OF THE INVENTION

The primary object of the invention is to provide a method for manufacturing of a nozzle with features of comfortable touch feeling and endurance.

The second object of the invention is to provide a firmly combined nozzle structure, which would not fall of the conduit due to the user's bite with great exertion.

To achieve the above objects, the invention includes the following steps:

1. forming a base with a closure and a supporting frame with two corresponding shafts on the top thereof via extruded hard plastic;
2. inserting a central mold into the supporting frame such that the shafts on the top of the supporting frame may be slightly outward;
3. secondly applying extruded plastic on the top of the supporting frame to form a mouthpiece; and
4. thirdly applying extruded plastic on the bottom of the supporting frame to accomplish a nozzle with excellent touch feeling and firm structure.

By way of the above steps, the nozzle according to the present invention presents a soft touch feeling and would not easily fall off of the conduit of the water bag due to the sucking of the user.

To completely appreciate these and other objects of the present invention as well as the invention itself, all of which will become apparent to those skilled in the art, the following detailed description of the invention and the claims should be read in conjunction with the accompanying drawings.

DETAILED DESCRIPTION OF PREFERRED EMBODIMENT

Figure 1:
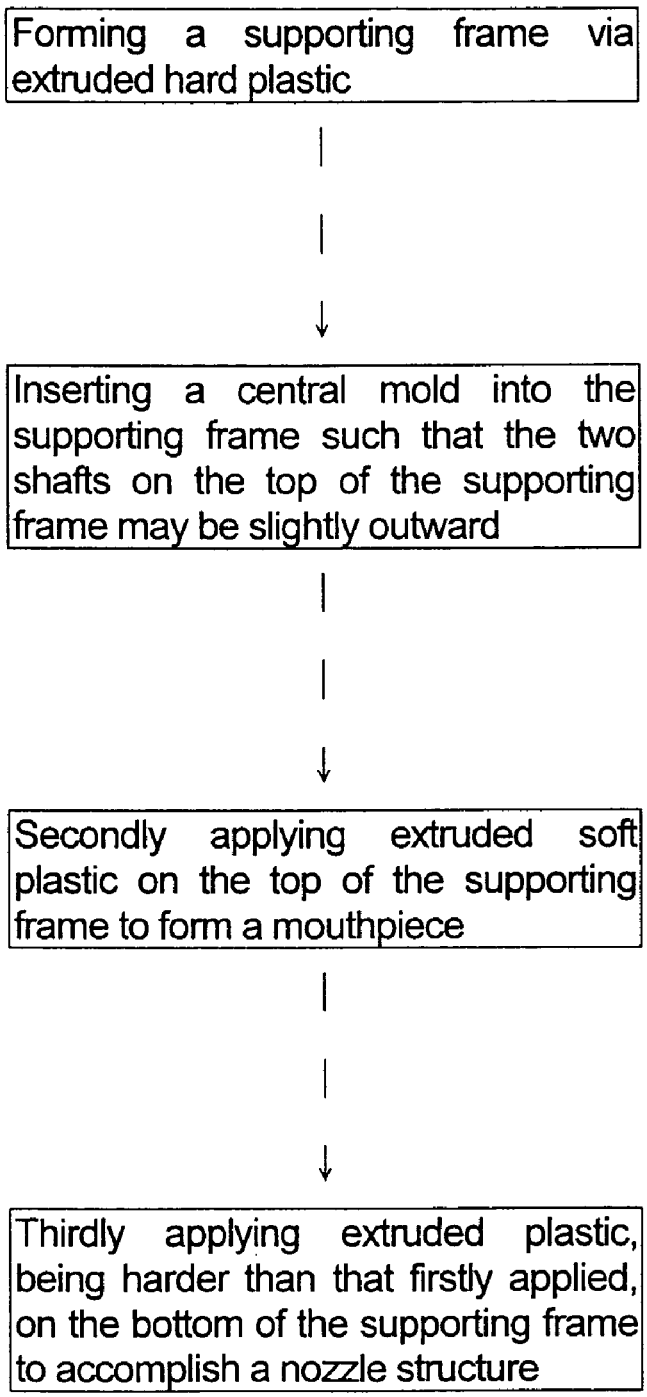
FIG. 1 is a flow chart showing the manufacturing processes of the invention.

Referring to FIG. 1, the invention includes the following steps:

1. forming a base with a closure and a supporting frame with two corresponding shafts on the top thereof via extruded hard plastic;
2. inserting a central mold into the supporting frame such that the shafts on the top of the supporting frame may become slightly outward;
3. secondly applying extruded plastic on the top of the supporting frame to form a mouthpiece; and
4. thirdly applying extruded plastic on the bottom of the supporting frame to accomplish a nozzle with excellent touch feeling and firm structure.

Figure 3:
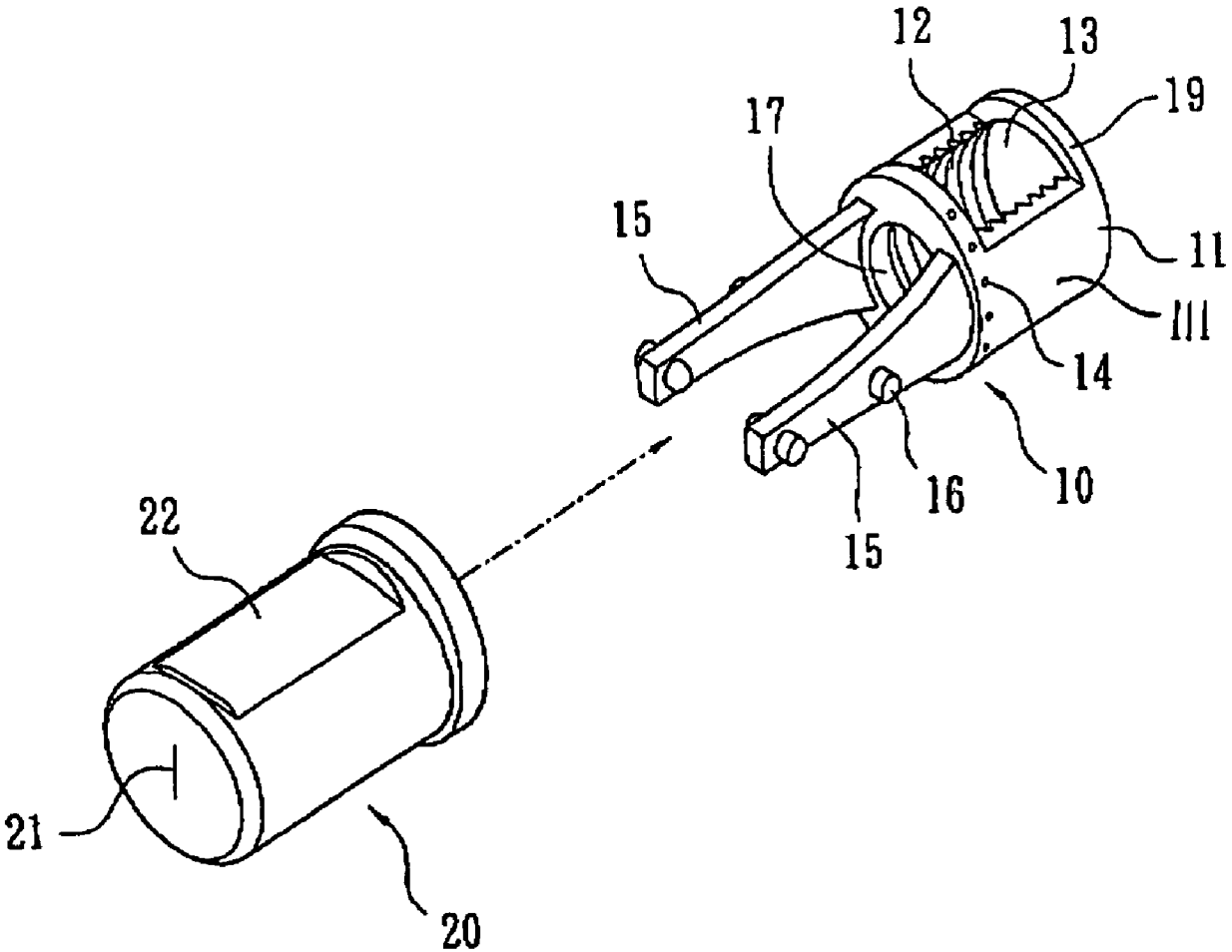
FIG. 3 is an exploded view showing the elements of the invention when applying the second extruded plastic.
Figure 4:
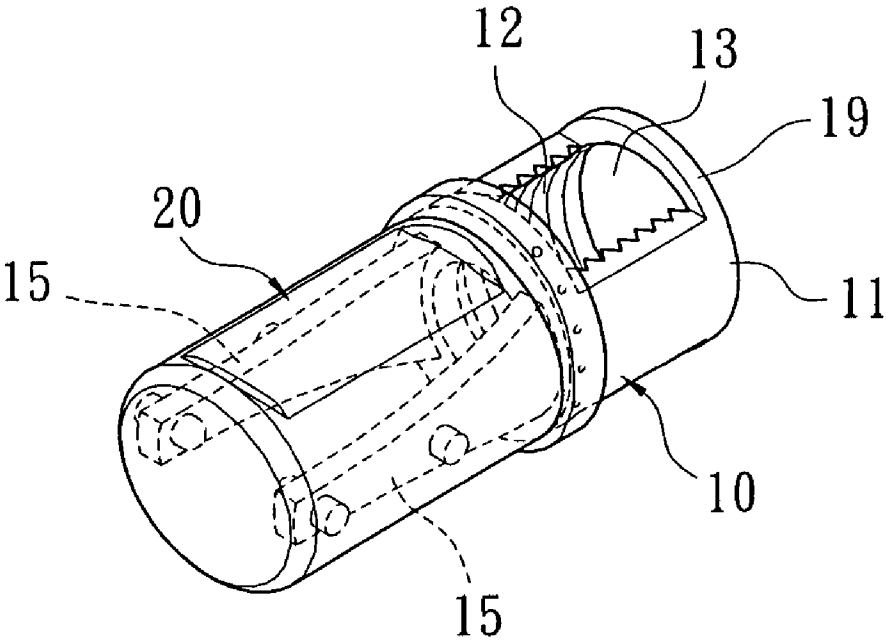
FIG. 4 is an exploded view showing the invention when completing the second plastic extruding as shown in FIG. 3.
Figure 5:
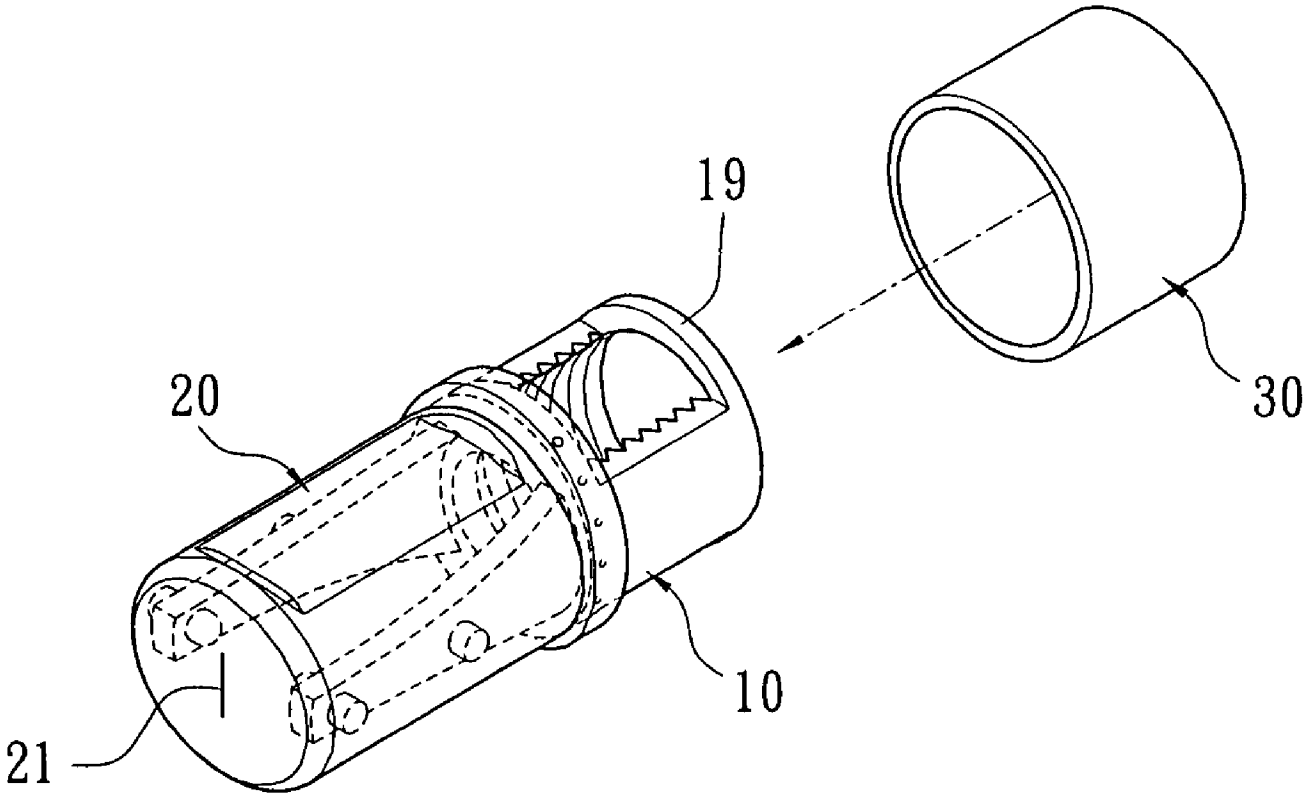
FIG. 5 is an exploded view showing the elements of the invention when applying the third extruded plastic.
Figure 6:
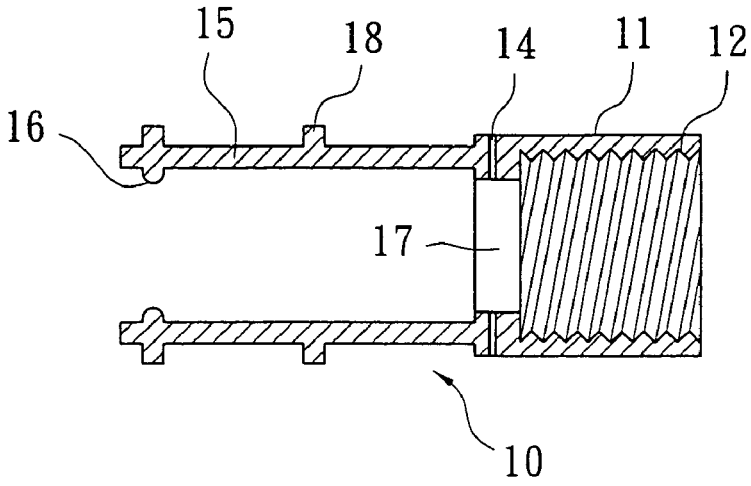
FIG. 6 is a sectional view of the support frame according to the invention.

Referring to FIGS. 3 and 6, in manufacturing the nozzle according to the invention, supporting frame 10 is formed by hard plastic. A closure 11 with an annular surface 111 is provided on the bottom of the supporting frame 10; and two corresponding shafts 15 are provided on the top of the supporting frame 10. The closure 11, being in the form of hollow cylinder, has interior teeth 12 on the interior surface, and has a central path hole 17 on the top surface. An opening 13 is provided on the corresponding sides of the peripheral of the closure 11. A plurality of connecting holes 14 pass through the root of the shafts 15 (i.e. the border with the closure 11). While the shafts 15 are extended from the corresponding sides of the central path hole 17 on the top surface of the closure 11, the shafts 15 are vertical to the direction of the openings 13. Besides, a first extrusion 16 and a second extrusion 18 are provided on each shaft 15.

Figure 9:
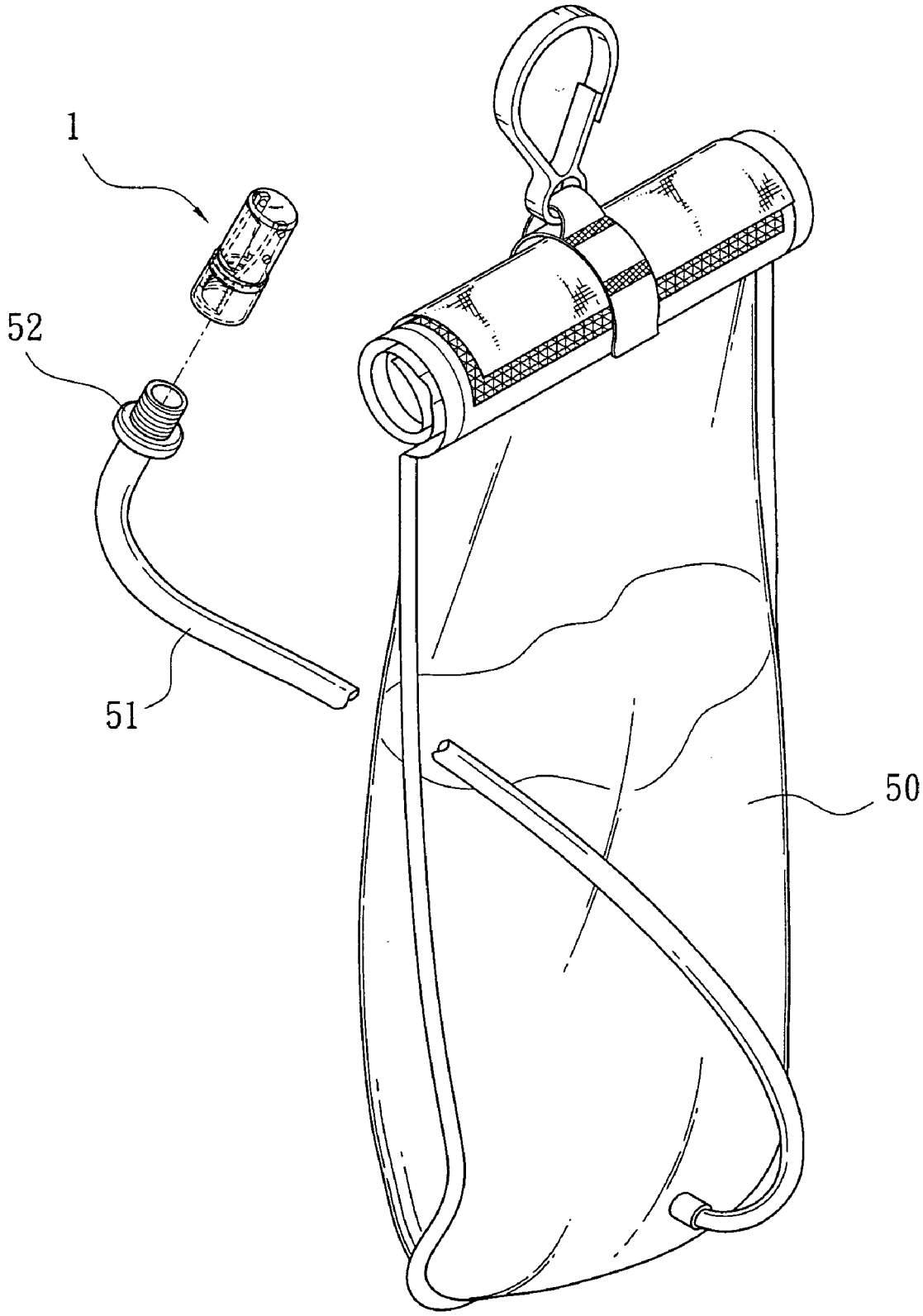
FIG. 9 is a schematic view of the invention incorporated with a water bag.

In the embodiment according to the invention, an enforcement threaded ring 19 of a complete circle is provided on the bottom of the closure 11 on the supporting frame 10. The threaded ring 19 is only 1mm high such that the closure 11 may firmly incorporate with the threaded base 52 (as shown in FIG. 9).

Figure 7:
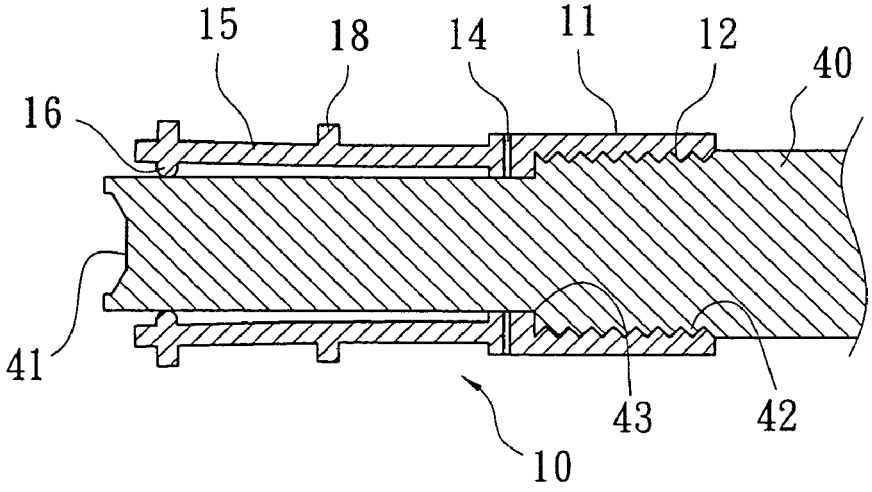
FIG. 7 is a sectional view of the invention in semi-process.

Now referring to FIG. 7, a mobile central mold 40 is threaded into the supporting frame 10. The central mold 40 provided on the shaft is provided with threads 42 and steps 43 in order to cooperate with the supporting frame 10. Besides, a groove 41 is provided on the top of the central mold 40 such that when the central mold 40 is threaded into the supporting frame 10, the first extrusions 16 on the two shafts 15 can be pressed by the central mold 40 and thereby the shafts 15 may become slightly outwards. After the shafts 15 become outwards, a soft plastic is applied to the supporting frame by way of injection, so that the supporting frame is integrally coated and a cover 20 is thereby formed. The cover 20 is made of soft and comfortable touch feeling plastic, and is firmly incorporated with the supporting frame 10 via the coating integral with the first extrusion 16 and second extrusions 18 provided on the interior and exterior of the shafts 15 and via the injection of soft plastic into the connecting holes 14 provided on the closure 11. A vertical water outlet 21 is provided on the top surface of the cover 20; and the water outlet 21 extends vertically to the direction the shafts 15 extend. The corresponding sides of the outer periphery of the cover 20 are respectively provided with plane surfaces 22, which are provided above and below the water outlet 21.

Figure 8:
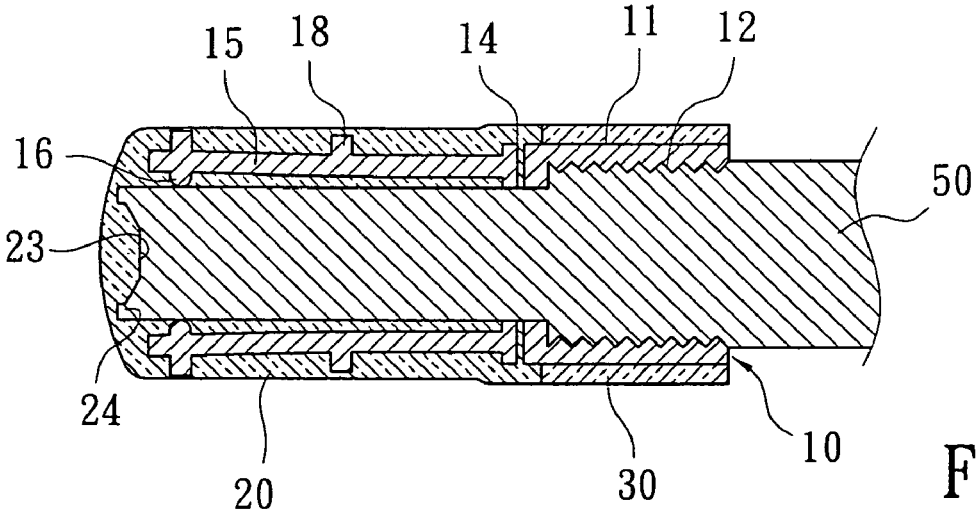
FIG. 8 is a sectional view of the invention after accomplishment.

As mentioned above, a groove 41 is provided on the top of the mobile central mold 40, so that after a cover 20 is formed by the second soft plastic rejection, a taper board 23 (as shown in FIG. 8) can be formed on the interior chamber of the cover 20. A peripheral groove 24 is provided on the rim of the root of the taper board 23 such that the center of the taper board 23 can be cut to form a water outlet 21, thereby when the nozzle 1 is pressed, the water outlet 21 can wholly open.

Figure 2:
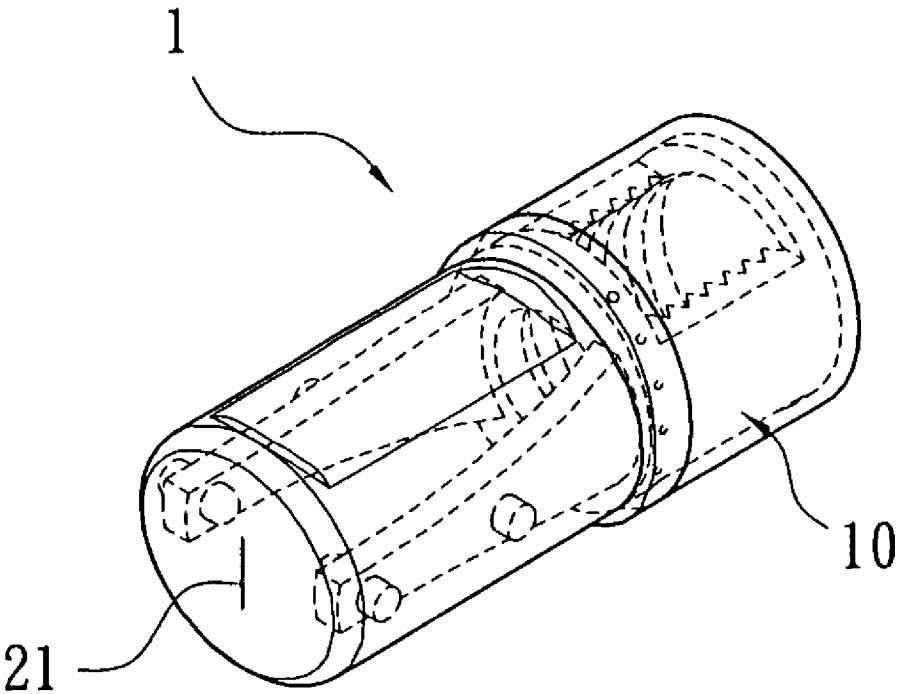
FIG. 2 is an exploded view of the invention.

Then, by way of thirdly injecting plastic, being rather hard than of the supporting frame 10, to coat the rear bottom of the supporting frame 10 to form a base socket 30 which is integrally connected with the cover 20 and can allow a proper elasticity and transformation via the corresponding openings 13 on the closure 11, thereby a nozzle 1 as shown in FIG. 2 is completed.

In the nozzle 1 according to the invention, as the cover 20 is made of plastic with soft and comfortable touch feeling, it is applicable to the user's mouth. And the plane surfaces 22 provided on the top of the cover 20 may ease the user to distinguish the right direction of biting the nozzle and to ease exertion of the mouth. While the shafts 15 extend outwardly, when the central mold 40 is ejected, the elasticity of the shafts 15 may be recovered and allow the water outlet 21 to shut down and thereby avoiding leakage due to the inadvertent open of the water outlet 21. The corresponding sides of the closure 11 are provided with openings 13, which are covered by relatively hard plastic of the base socket 30. As the elasticity of the base socket 30 is better than the supporting frame 10 made of relatively hard plastic, when the closure 11 of the nozzle 1 is fastened to the threaded base 52 of the conduit 51 of the water bag 50, the cover 30 may form a enforced coating material to the exterior of the closure 11, such that the interior teeth 12 of the closure 11 may firmly incorporate with the threaded base 52, thereby preventing the closure 11 from slipping open.

The base socket 30 of the closure 11 is harder than the cover 20. The soft plastic forming the cover 20 can inject into the plurality of connecting holes 14 provided on the supporting frame 10 when forming the cover 20 via extruded soft plastic, thereby firmly incorporating the cover 20 and the supporting frame 10. When the user bites the nozzle 1, the top of the cover 20 above the connecting holes 14 would not be moved by the biting force, therefore the border where made of soft plastic and harder plastic would not slip open due to different deformation degrees, thereby the whole nozzle 1 can firmly incorporate with the conduit 51 of the water bag 50.

Concluded the above, the nozzle and the manufacturing method thereof according the invention have the following utilities and advantages:

1. By injecting plastic of different hardness, the user may have soft and comfortable feeling when holding the nozzle in mouth.

2. Given that the closure of the supporting frame appears in a close status and that the base socket covered on the interior thereof is made of harder plastic (harder than the material of the supporting frame), it can be firmly incorporated with the conduit of the water bag without the risk of slipping open when the nozzle is in use.

3. In manufacture, the supporting frame can be firmly combined by way of the plurality of connecting holes, shafts and extrusions in second plastic extrusion.

Although specific embodiments have been illustrated and described, it will be obvious to those skilled in the art that various modifications may be made without departing from what is intended to be limited solely by the appended claims.

Concluded the above, the invention discloses an innovated nozzle and the manufacturing method thereof, which may improve the disadvantage of the prior art, i.e. easily slipping open, and provide a manufacturing method for making an ease made and firmly incorporated nozzle structure which is novel and rich of commercial value as claimed by the inventor.

The invention claimed is:

1. A nozzle structure comprising:

a supporting frame having an upstream end and a downstream end, said upstream end being provided with a circular closure with internal threads and two openings that are opposite with each other, said openings with planar axis parallel to a longitudinal axis of said supporting frame, said circular closure having an annular surface, two shafts protruding longitudinally out of said annular surface and each of said shafts being on opposite side of the other, a plurality of connecting holes located on said downstream end of said closure and adjacent to said annular surface;

a cover covering on a top of said supporting frame and firmly incorporating with said supporting frame by way of said connecting holes, a water outlet being provided on a center of a cover top; and a base socket which covers a center of said supporting frame and integrally combines with said cover.

2. The nozzle structure according to claim 1, wherein said two openings are vertical to said shafts.

3. The nozzle structure according to claim 1, wherein a plane surface is provided on upper and lower rims of said cover.

4. The nozzle structure according to claim 1, wherein a board in form of a reinforced threaded ring is provided on a bottom of said closure.

5. The nozzle structure according to claim 1, wherein a taper board and a peripheral groove are provided on an interior chamber of said cover; and a peripheral groove is formed by a thin board.

* * * * *